US005823804A

United States Patent [19]

Auclair

[11] Patent Number: 5,823,804

[45] Date of Patent: Oct. 20, 1998

[54] CABLE SHIELD CONNECTOR WITH SPARK GAP

[75] Inventor: John W. Auclair, Norfolk, Conn.

[73] Assignee: Electric Motion Company, Inc., Winsted, Conn.

[21] Appl. No.: 821,093

[22] Filed: Mar. 20, 1997

[51] Int. Cl.[6] ..... H01R 4/66

[52] U.S. Cl. ..... 439/98; 439/52

[58] Field of Search ..... 439/98, 100, 52, 439/118, 92

[56] References Cited

U.S. PATENT DOCUMENTS

| | | | |
|---|---|---|---|
| 4,257,658 | 3/1981 | Hammond et al. | 439/98 OR |
| 4,842,530 | 6/1989 | Erickson | 439/98 OR |
| 5,429,532 | 7/1995 | Auclair | 439/98 X |

*Primary Examiner*—Neil Abrams
*Assistant Examiner*—Daniel Wittels
*Attorney, Agent, or Firm*—Alix, Yale & Ristas, LLP

[57] ABSTRACT

A connector for clamping to a cable shield to provide a ground connection employs a U-shaped yoke. A keeper threadably engages thread surfaces at the interior side of the yoke legs. A clamp jaw on the keeper is compressively engaged against a cable shield received in an aperture defined by the yoke. The yoke connects to a flexible ground wire via a spark gap assembly. An electrically conductive boss extends from the yoke into one end of a bore in an electrically non-conductive separator member. The ground wire is mounted to the separator member by an electrically conductive fastener that extends into the other end of the bore of the separator member. The distal ends of the boss and the fastener are separated by a spark gap. The distal end of an electrically conductive bridging member is positionable in the separator member to engage the distal end portions of the boss and the fastener to bridge the spark gap and provide electrical communication therebetween.

16 Claims, 4 Drawing Sheets

CABLE SHIELD CONNECTOR WITH SPARK GAP

BACKGROUND OF THE INVENTION

This invention relates generally to devices for implementing a ground connection between a metallic shield of a cable and a common ground point. More particularly, the present invention relates generally to clamp devices which mount to service cables and connect via a flexible conductor with a common ground point.

A number of various types of devices have been employed for connecting a ground wire with the tubular ground shields of buried service wires. Most conventional devices employ clamp assemblies of various forms. In applications to which the present invention relates, the connecting devices are ordinarily positioned within a cabinet, housing or other enclosure, hereafter collectively termed "enclosure", to provide a grounding connection between the metallic shield of the service cable and a common ground point.

It has been found that the cable ground shields may carry circulating electrical currents. Usually, this situation occurs when the electrical power supply and telephone service are grounded in the same pedestal and the power neutral of the electrical power supply does not perform properly. The telephone cable shield will act as the electrical power neutral in this situation. The telephone cable shield is not designed to carry this type of current for an extended period of time and operation in this manner can result in overheating of the cable and equipment damage.

Some telephone service technicians leave the telephone cable shield ungrounded to prevent the shield from acting as the power neutral. Other technicians put a circumferential slit in the cable jacket at the distribution end, and by centering the clamp over the slit, an indirect connection is made. The gap prevents the flow of current when the applied voltage is in the range of hundreds of volts. If the gap is sized properly, an applied voltage in the range of thousands of volts will cause an arc to bridge the gap, allowing the flow of current. Consequently, the cable shield will not function as a power neutral but will ground a large electrical transient of the type experienced during a lightning strike. The amount of voltage that is required to bridge the gap is determined by the width of the gap. For example, a power supply of approximately one-thousand (1,000) volts is required to bridge a gap having a width of 0.010 inches. Since the telephone service technician typically cuts the gap in the field, control of the gap width is problematic.

SUMMARY OF THE INVENTION

Briefly stated, the invention in a preferred form is a cable shield connector having an integral spark gap for connecting a service cable shield with a flexible ground conductor. The cable shield connector has a clamp mechanism that engages the cable shield and provides electrical communication with the shield. A separator member composed of electrically non-conductive material is positioned intermediate the clamp mechanism and the ground conductor to electrically separate them. The first end of a passageway through the separator member receives an electrical conductor that is in electrical communication with the clamp mechanism. The second end of the passageway receives a connector, composed of electrically conductive material, that connects the ground conductor to the separator member. The distance between the distal end of connector and the distal end of the electrical conductor defines the spark gap.

An electrically conductive bridging member is threadably mounted in an opening that intersects the passageway at the spark gap. The bridging member is positionable in the opening such that the bridging member may be engaged with the connector and the electrical conductor to bridge the spark gap. Preferably, the bridging member comprises a bolt having a head and a threaded shaft. To prevent inadvertent bridging of the spark gap, a tubular shield member composed of electrically non-conductive material is disposed around the separator member. A slot extends between the inner and outer surfaces of the shield member. A first portion of the slot has a diameter which is greater than diameters of the bolt head and the bolt shaft and a second portion of the slot has a diameter which is greater than the diameter of the bolt shaft but less than the diameter of the bolt head. When the first portion of the slot is positioned under the bolt head, the bolt head may be positioned in the first portion of the slot such that the bottom surface of the bolt head engages the outer surface of the separator member. When the second portion of the slot is positioned under the bolt head, the bottom surface of the bolt head engages the outer surface of the shield member. The thickness of the shield member is determined such that the distal end of the bolt shaft is positioned at a distance greater than the width of the spark gap when the bottom surface of the bolt head engages the outer surface of the shield member.

An object of invention is to provide a new and improved cable shield connector having an integral spark gap for implementing a ground connection between the metallic shield of a service cable and a common ground point.

Another object of the invention is to provide a new and improved cable shield connector which provides an open circuit for voltage potentials in the range of hundreds of volts and which provides a closed circuit for voltage potentials in the range of thousands of volts.

A further object of the invention is to provide a new and improved cable shield connector which has an integral spark gap and an integral bridge for bypassing the spark gap.

Other objects and advantages of the invention will become apparent from the specification and the drawings.

DETAILED DESCRIPTION OF THE PREFERRED EMBODIMENT

Figure 1:
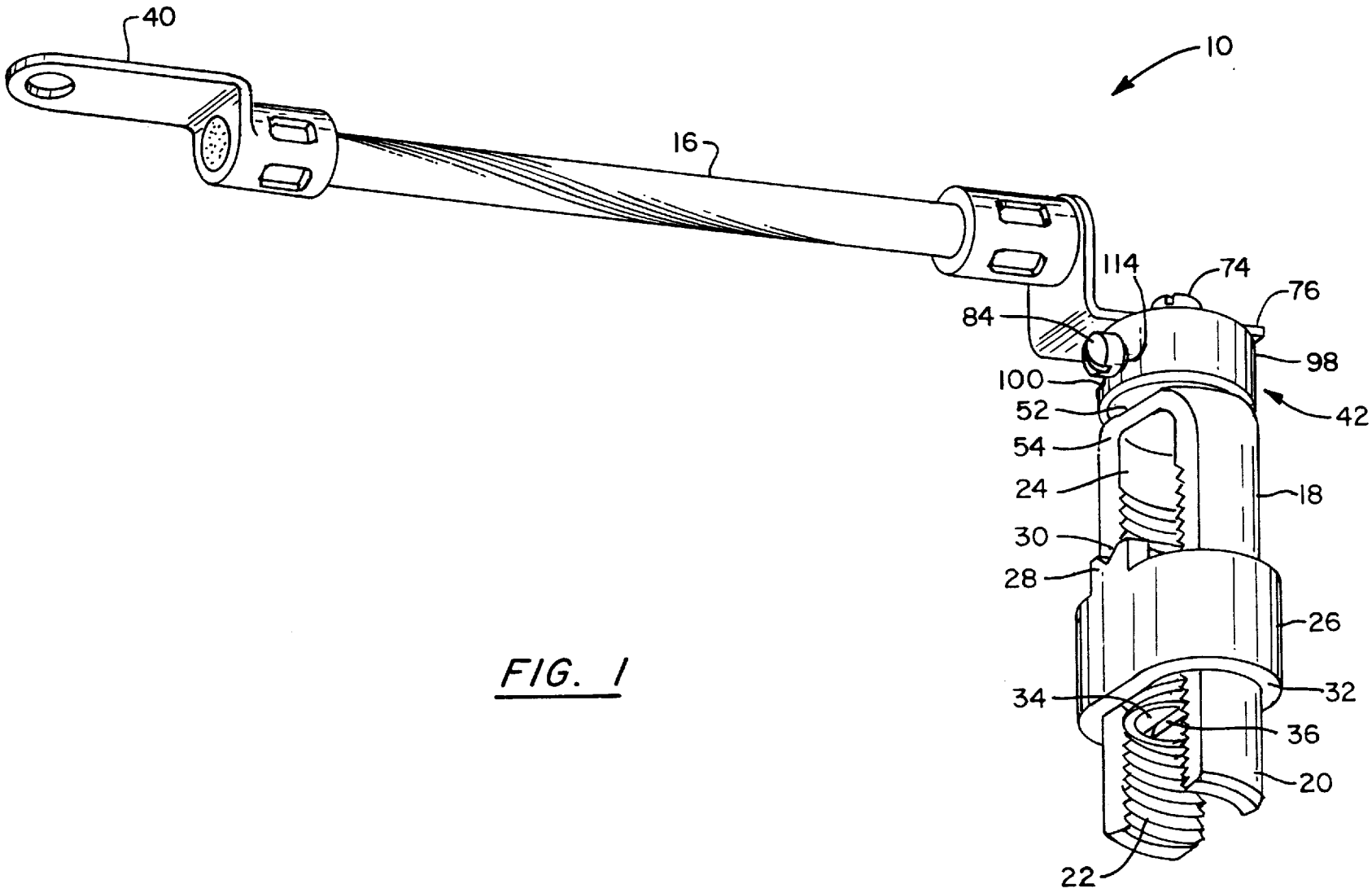
FIG. 1 is a perspective view of a cable shield connector in accordance with the present invention, illustrated in conjunction with a ground wire.

With reference to the drawings wherein like numerals represent like parts throughout the Figures, a cable shield connector in accordance with the present invention is generally designated by the numeral 10. The clamp 10 is particularly adapted for receiving one or more service wires 12 and connecting the tubular metallic shields 14 of the wires to a common ground point. Preferably, the ground connection 16 is provided by a flexible wire or other conventional grounding connector. The cable shield connector 10 is adapted for use with a pedestal to provide a flexible connection which allows the service wire cables and the pedestal to move independently of each other when frost or other environmental forces result in relative disparate displacement.

Figure 2:
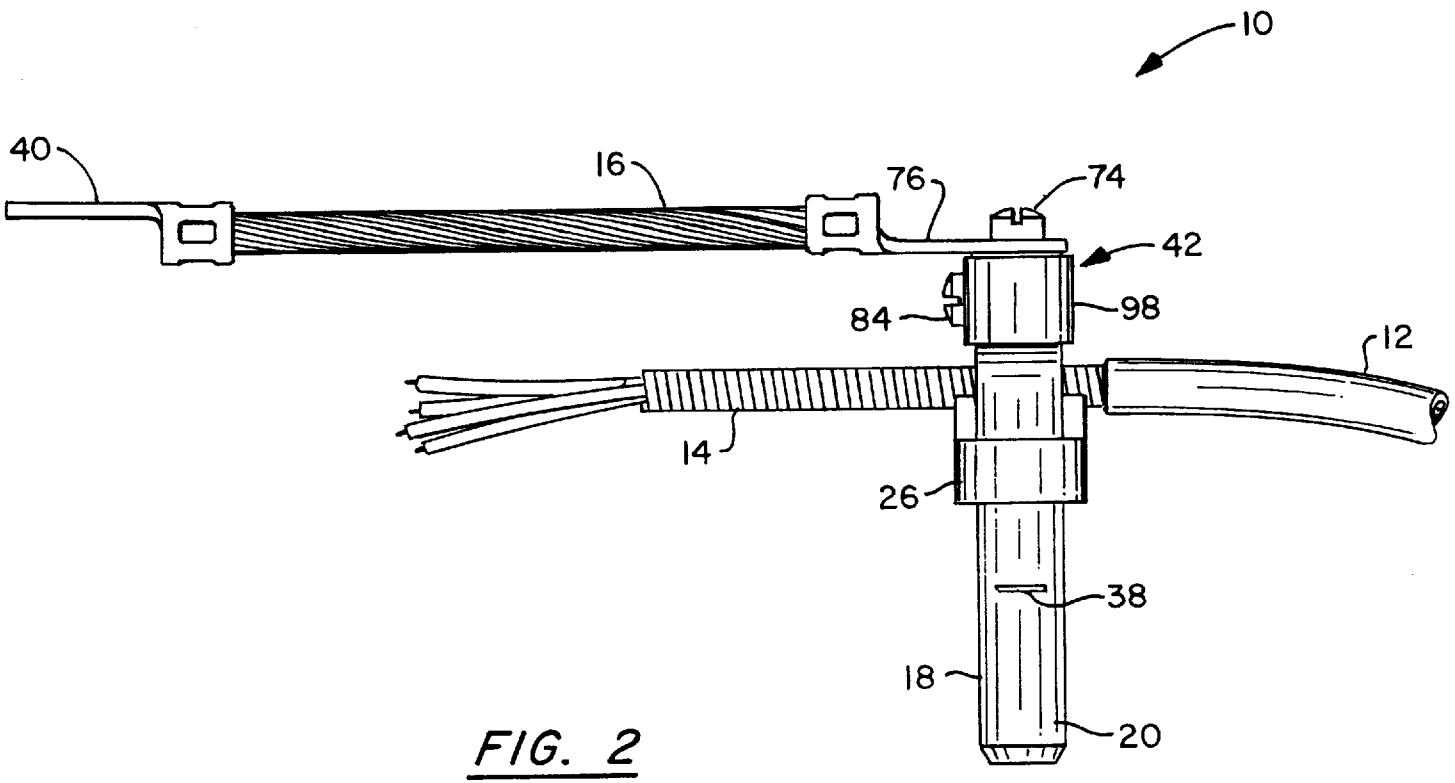
FIG. 2 is a side elevational view of the cable shield connector and ground wire of FIG. 1 together with a service wire.

With reference to FIGS. 1 and 2, the cable shield connector 10 comprises a generally U-shaped yoke 18 having generally parallel legs 20. The legs 20 of the yoke 18 have respective opposed inwardly disposed thread surfaces 22. A receiving aperture 24 is generally formed at the upper inward portion of the yoke 18 for receiving one or more service wire ground shields 14. The ground shields 14 are compressively secured to the clamp by means of a keeper 26 which is slidably displaceable and selectively fixedly positionable along the legs 20 of the yoke 18.

The keeper 26 includes an upper clamp jaw 28 which in a preferred form has a laterally extending V-shaped recess or groove 30. The groove 30 enhances surface contact with the ground shield 14 and provides a more intimate clamping engagement. The body of the keeper 26 includes a pair of integral guide skirts 32. The guide skirts 32 form axial openings which are dimensioned to be greater than the sections of the legs 20 of the yoke 18 to permit sliding displacement relative thereto. The guide skirts 32 and also function to limit lateral separation between the legs 20 of the yoke 18 which are generally parallel regardless of the position of the keeper 26. The yoke 18 and keeper 26 typically have a tin plated brass composition or a zinc with copper/tin plated composition.

The position and displacement of the keeper 26 is governed by a threaded driver 34. The threaded driver 34 is rotatably mounted at the underside of the clamp jaw 28. The driver 34 has a helical threaded surface which is dimensioned for threading engagement with the complementary thread surfaces 22 of the yoke 18. The underside of the driver 34 includes a recessed slot 36 which is dimensioned to receive a blade of a screwdriver or similar tool for torquing the driver 34. The recess walls retain the blade as it rotates. Alternately, the slot 36 may not be recessed. The driver 34 threadably engages the surface of the yoke 18 and is threadably displaceable along the legs 20 of the yoke 18 for selectively compressively clamping the jaw 28 against a received ground shield 14. The clamp engagement with the ground shield 14 is maintained by the threaded engagement between the driver 34 and the yoke 18 which is also laterally reinforced by the guide skirts 32.

Because of the variable displacement of the keeper 26 and the dimensions of the legs 20, the receiving aperture 24 is dimensioned to receive and clamp one or more ground shields 14 in generally parallel adjacent relationship. The outer surface of the yoke legs 20 may be traversed by generally aligned indentations 38 (not visible in FIG. 1). The indentations 38 function to allow the unneeded distal portions of the yoke 18 to be snapped off and removed with pliers, thereby resulting in a more compact assembly. For example, if one or a small number of ground shields 14 are connected for a given application, the latter breakaway design allows the installer at the installation site to remove the extreme leg segments of the yoke 18 when the variable aperture dimension required is relatively small to thereby provide a more compact assembly.

The open ended design for the clamp allows the keeper 26 to be completely dismounted from the yoke 18 so that the clamp may be installed onto a wire which is already in service. In addition, the clamp may be disassembled, i.e., the keeper 26 disengaged from the yoke 18, to isolate the ground.

Figure 9:
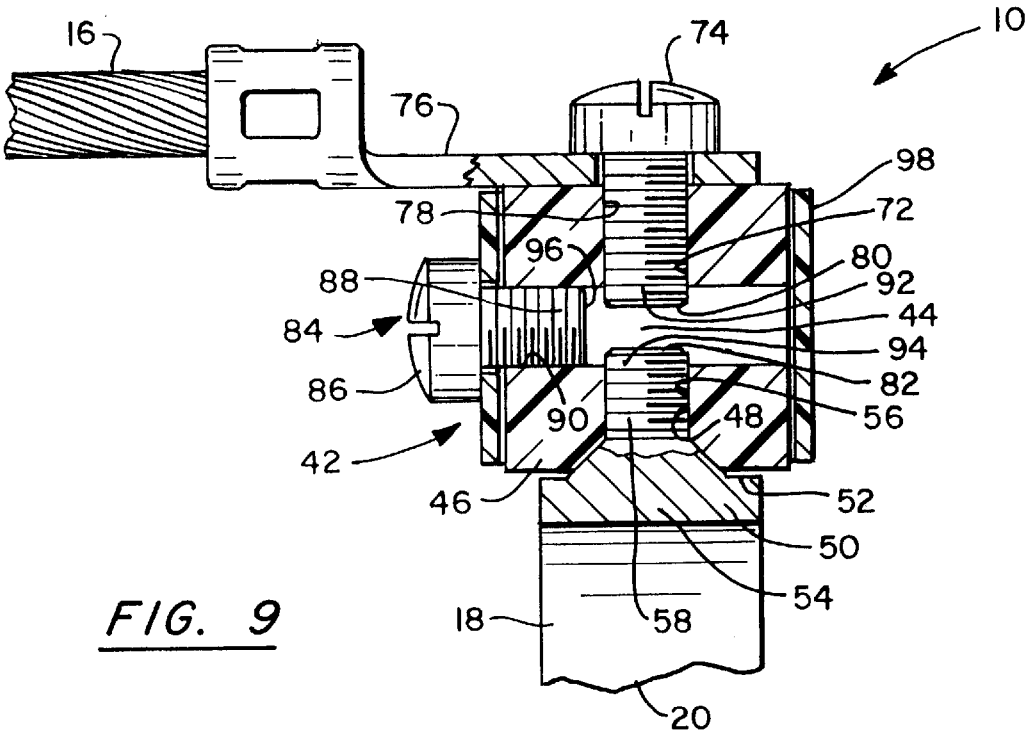
FIG. 9 is an enlarged side view, partly broken away and partly in section, of the connector of FIG. 1, illustrating the gap bolt in the open circuit position.
Figure 10:
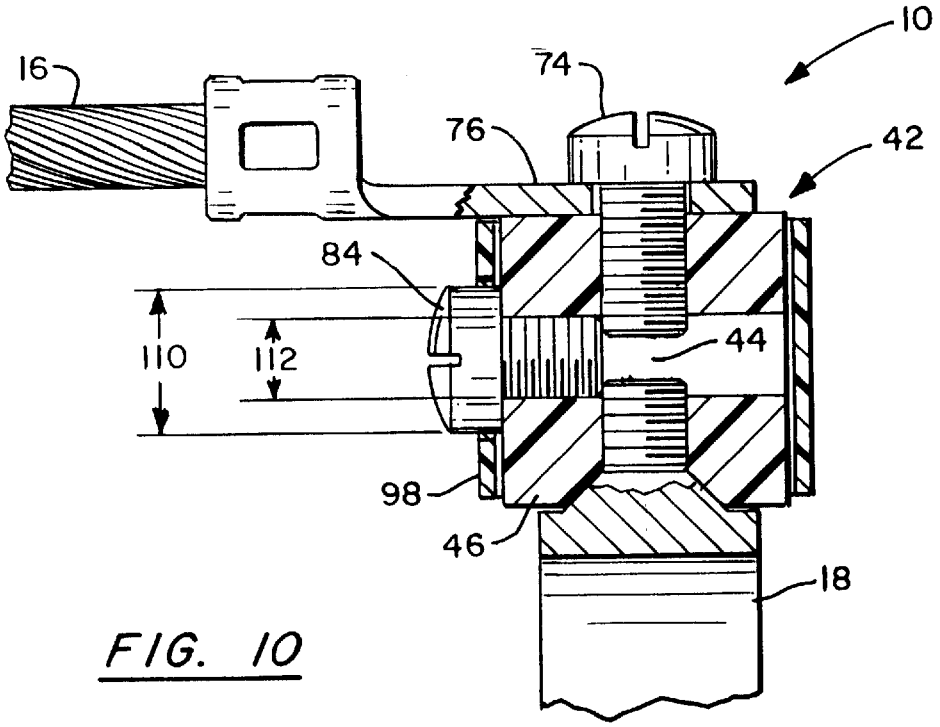
FIG. 10 is an enlarged side view, partly broken away and partly in section, of the connector of FIG. 1, illustrating the gap bolt in the closed circuit position.

A grounding connector 16 such as a flexible ground wire provides an electrical ground path for the yoke 18. The ground wire is typically a six inch #6 or #10 AWG lead wire and the wire terminal 40 is connected to a ground stud (not illustrated) in the pedestal. A separator assembly 42 is positioned between the grounding connector 16 and the yoke 18 to provide a spark gap 44 between the grounding connector 16 and the yoke 18, as shown in FIGS. 9 and 10. The width of the spark gap 44 is selected such that the spark gap 44 may be bridged by an electrical arc only when the voltage potential across the spark gap 44 is in the range of thousands of volts. A large electrical transient of the type experienced during a lightning strike has a voltage potential in the thousands of volts and will therefore cause an electrical arc to bridge the spark gap 44, completing the electrical path to ground. Since the voltage potential for conventional electrical power supplies is in the range of hundreds of volts, the spark gap 44 will electrically separate the grounding connector 16 from the yoke 18, preventing the cable shield 14 from acting as the power neutral.

Figure 5:
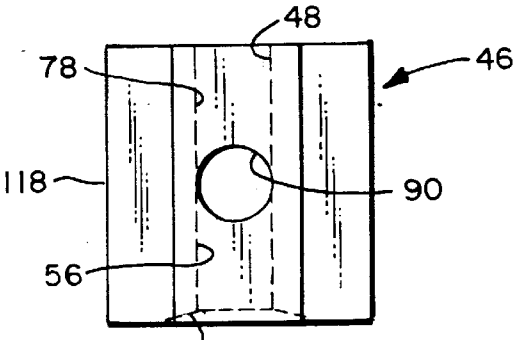
FIG. 5 is a side elevational view of the separator member of FIG. 4.
Figure 6:
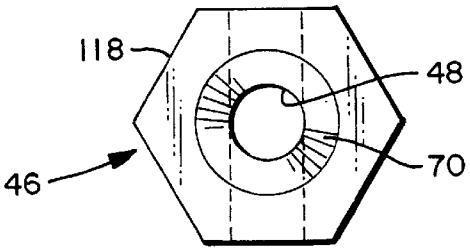
FIG. 6 is a bottom view of the separator member of FIG. 4.
Figure 4:
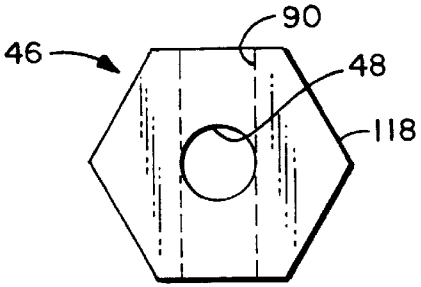
FIG. 4 is an enlarged top view of the separator member of FIG. 1.

With reference to FIGS. 3–10, the separator assembly 42 includes a separator member 46 composed of electrically non-conductive material, preferably a non-conductive polymeric material. An axial bore 48 extends between the upper and lower surfaces of the separator member 46 (FIGS. 4–6). An electrical conductor member 50 extends upwardly from the upper surface 52 of the bight 54 of the yoke 18 and is received in the lower end portion 56 of the bore 48. In one embodiment (FIGS. 9 and 10), the electrical conductor member 50 comprises a threaded boss 58 that is integral with the yoke 18. In another embodiment (FIG. 3), the electrical conductor member 50 is a screw 60 that has a lower shaft portion 62 that is received in an opening 64 in the bight 54 of the yoke 18 and an upper shaft portion 66 that extends upwardly from the upper surface 52 of the bight 54. The threaded lower shaft portion 62 of the screw 60 may be threadably mounted to the opening 64. Alternatively, the portion of the shaft that is adjacent to the upper surface 52 of the bight 54 may be upset to form a full or partial collar 68 that engages the upper surface 52 of the bight 54. The threaded upper shaft portion 66 of the electrical conductor member 50 engages the surface of the bore 48 to mount the separator member 46 to the yoke 18. In one embodiment, the partial collar 68 defines a plurality of teeth that engage the surface of a cavity 70 in the lower end of the separator member 46 (FIGS. 5 and 6) to resist rotational movement between the yoke 18 and the separator member 46. The separator member 46 may have a polygonal shape, as shown in FIGS. 4 and 6, to facilitate mounting to the electrical conductor member 50.

With reference to FIGS. 9 and 10, the threaded shaft 72 of a set screw 74 composed of electrically conductive material extends through a wire terminal 76 and into the upper end portion 78 of the bore 48 to mount the grounding connector 16 to the separator member 46. The space between the distal end 80 of the shaft of the set screw 74 and the distal end 82 of the shaft of the electrical conductor member 50 defines the spark gap 44 (FIGS. 9 and 10). As discussed above, the width of the spark gap 44 is selected to prevent arcing across the gap 44 when the electrical potential is in the range of hundreds of volts and to allow arcing across the gap 44 when the electrical potential is in the rang of thousands of volts. A gap 44 of 0.010 inches may be bridged by a voltage potential of approximately 1,000 volts and a gap 44 of 0.030 inches may be bridged by a voltage potential of approximately 3,000 volts.

To provide flexibility of application, a cable shield connector 10 in accordance with the invention will preferably include an electrically conductive bridging member 84 that may be positioned to engage the set screw 74 and the electrical conductor member 50 and thereby bridge the spark gap 44. Preferably, the bridging member 84 comprises a bolt composed of electrically conductive material having a head 86 and a threaded shaft 88. The shaft 88 is received in and threadably 30 engages the surface of an opening 90 that intersects the bore 48 at the spark gap 44. Preferably, the opening 90 has an axis that is perpendicular to the axis of the bore 48. The distal end portions 92, 94 of the shaft of the screw 74 and the electrical conductor member 50 extend into the portion of the bore 48 that is intersected by the opening 90 such that the distal end 96 of the bolt may be positioned to engage the distal end portions 92, 94 of the set screw 74 and the electrical conductor member 50.

Figure 8:
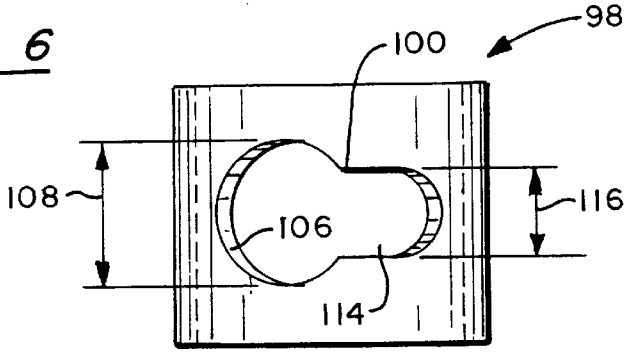
FIG. 8 is a side elevational view of the shield member of FIG. 7.
Figure 7:
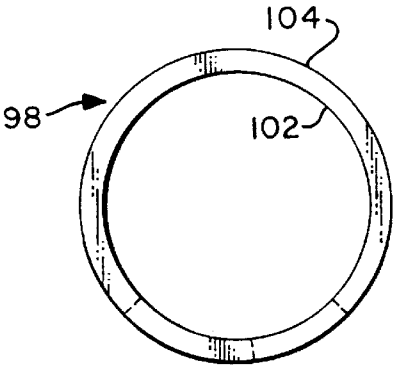
FIG. 7 is an enlarged top view of the shield member of FIG. 1.
Figure 3:
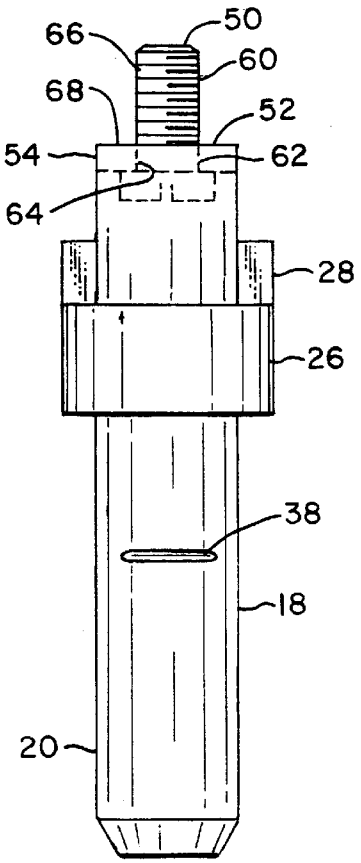
FIG. 3 is a side elevational view, partly in phantom, of the yoke and keeper of FIG. 1.

To prevent inadvertent bridging of the spark gap 44, a tubular shield member 98 (FIGS. 7 and 8) is disposed around the separator member 46. Preferably, the shield member 98 is composed of electrically non-conductive material so that the shield member 98 cannot bridge the spark gap 44. As shown in FIGS. 7 and 8, a slot 100 extends between the inner and outer surfaces 102, 104 of the shield member 98. The bolt shaft 88 extends through the slot 100 to mount the shield member 98 to the separator member 46. A first portion 106 of the slot 100 has a diameter 108 which is greater than diameters 110, 112 of the bolt head 86 and the bolt shaft 88 (FIG. 10) and a second portion 114 of the slot 100 has a diameter 116 which is greater than the diameter 112 of the bolt shaft 88 but less than the diameter 110 of the bolt head 86.

The shield member 98 may be rotated to position either the first or the second portion 106, 114 of the slot 100 under the bolt head 86. Consequently, when the first portion 106 of the slot 100 is positioned under the bolt head 86, the bolt head 86 may be screwed into the first portion 106 of the slot 100 whereby the bottom surface of the bolt head 86 engages the outer surface 118 of the separator member 46. When the second portion of the slot is positioned under the bolt head, the bottom surface of the bolt head engages the outer surface 104 of the shield member 98. The thickness of the shield member 98 is determined such that the distal end 96 of the bolt shaft 88 is positioned at a distance greater than the width of the spark gap 44 when the bottom surface of the bolt head 86 engages the outer surface 104 of the shield member 98. Consequently, the bridging member 84 cannot bridge the spark gap 44 when the second portion 114 of the slot 100 is positioned under the bolt head 86.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A cable shield connector comprising:

cable shield engagement means for engaging and providing electrical communication with said cable shield;

a ground conductor for electrically connecting said engagement means with a ground;

separator means disposed intermediate said engagement means and said ground conductor for electrically separating said engagement means from said ground conductor, said separator means comprising a separator member composed of electrically non-conductive material and comprising a passageway having first and second end portions;

electrical conductor means for conducting electricity, said conductor means being in electrical communication with said engagement means and extending into said first end portion of said passageway to a distal end; and connector means for connecting said ground conductor to said separator member, said connector means being composed of electrically conductive material and being in electrical communication with said ground conductor, said connector means extending into said second end portion of said passageway to a distal end;

wherein said distal end of said conductor means and said distal end of said connector means define a spark gap.

2. The cable shield connector of claim 1 wherein said passageway comprises an axial bore.

3. The cable shield connector of claim 1 said separator member further comprises an opening intersecting said passageway at said gap and an electrically conductive bridging member disposed in said opening, said bridging member being positionable in said opening to engage said conductor means and said connector means to provide electrical communication therebetween.

4. The cable shield connector of claim 3 wherein said connector means and said conductor means each comprise a distal end portion, each of said distal end portions being disposed in said passageway adjacent said opening, said bridging member having a surface that is threadably engaged with said opening, wherein said bridging member is threadably positionable in said opening whereby said bridging member is engageable with said distal end portion of said conductor means and said distal end portion of said connector means.

5. The cable shield connector of claim 3 wherein said bridging member comprises a bolt having a head and a threaded shaft and said separator means further comprises a tubular shield member composed of electrically non-conductive material and defining a cavity for receiving said separator member and a slot having a first slot portion for receiving said bolt, said bolt head, said bolt shaft and said first slot portion each having a diameter wherein said diameter of said first slot portion is greater than said diameter of said bolt head and said diameter of said bolt shaft, whereby said bolt head is disposed in said first slot portion when said bolt engages said conductor means and said connector means.

6. The cable shield connector of claim 5 wherein said shield member comprises inner and outer surfaces defining a thickness and said slot further has a second slot portion, said second slot portion being in communication with said first slot portion and having a diameter that is greater than said diameter of said bolt shaft and smaller than said diameter of said bolt head, said thickness of said shield member being predetermined whereby said bolt does not engage said conductor means and said connector means when said bolt head engages said outer surface of said shield member.

7. The cable shield connector of claim 1 wherein said electrical conductor means comprises a boss, said boss being integral with said engagement means and extending outwardly therefrom.

8. The cable shield connector of claim 7 wherein said boss has a threaded surface for threadably engaging said passageway of said separator means, whereby said boss mounts said separator means to said engagement means.

9. The cable shield connector of claim 1 wherein said engagement means comprises an opening and said electrical conductor means comprises bolt means having a threaded shaft, said shaft of said bolt means being engaged with said opening of said engagement means and extending outwardly therefrom.

10. A cable shield connector for connecting a cable shield with a ground conductor comprising:

a generally U-shaped yoke having a bight, electrical conductor means extending outwardly from the bight for conducting electricity, and a pair of legs defining an aperture for receiving at least one cable shield, said legs having opposed thread surfaces;

keeper means threadably mounted to said legs of said yoke for compressively engaging a cable shield;

a separator member composed of electrically non-conductive material and comprising a passageway having first and second end portions, said conductor means of said yoke extending into said first end portion of said passageway to a distal end;

mounting means for mounting the ground conductor to said separator member, said mounting means being composed of electrically conductive material and extending into said second end portion of said passageway to a distal end;

wherein said distal end of said conductor means and said distal end of said mounting means define a spark gap.

11. The cable shield connector of claim 10 wherein said separator member further comprises an opening and an electrically en conductive bridging member threadably mounted in said opening, said opening intersecting said passageway at said gap, said bridging member being threadably positionable in said opening to engage said conductor means and said mounting means to provide electrical communication therebetween.

12. The cable shield connector of claim 11 further comprising a tubular shield member composed of electrically non-conductive material, said shield member defining a slot having a first slot portion and a cavity for receiving said separator member, said bridging member comprising a bolt having a head and a threaded shaft, said bolt head, said bolt shaft and said first slot portion each having a diameter wherein said diameter of said first slot portion is greater than said diameter of said bolt head and said diameter of said bolt shaft, whereby said bolt head is disposed in said first slot portion when said bolt engages said conductor means and said mounting means.

13. The cable shield connector of claim 12 wherein said shield member comprises inner and outer surfaces defining a thickness and said slot further has a second slot portion, said second slot portion being in communication with said first slot portion and having a diameter that is greater than said diameter of said bolt shaft and smaller than said diameter of said bolt head, said thickness of said shield member being predetermined whereby said bolt does not engage said conductor means and said mounting means when said bolt head engages said outer surface of said shield member.

14. The cable shield connector of claim 10 wherein said electrical conductor means comprises a boss having a threaded surface for threadably engaging said passageway of said separator means, whereby said boss mounts said separator means to said yoke.

15. The cable shield connector of claim 10 wherein said bight of said yoke defines an opening and said electrical conductor means comprises a threaded shaft, said shaft being engaged with said opening of said bight and extending outwardly therefrom.

16. The cable shield connector of claim 10 wherein said electrical conductor means comprises teeth means extending outward from said bight of said yoke for engagement with said separator member.

* * * * *